US005731662A

United States Patent [19]

Parrott et al.

[11] Patent Number: 5,731,662

[45] Date of Patent: Mar. 24, 1998

[54] METAL HALIDE LAMP WITH GETTER

[75] Inventors: Richard A. Parrott, Merrimack, N.H.; John A. Scholz, Georgetown; David Goodman, Amesbury, both of Mass.

[73] Assignee: Osram Sylvania Inc., Danvers, Mass.

[21] Appl. No.: 886,663

[22] Filed: Jul. 2, 1997

Related U.S. Application Data

[63] Continuation of Ser. No. 598,756, Feb. 8, 1996, abandoned.

[51] Int. Cl.[6] ..... H01J 61/26; H01J 17/24

[52] U.S. Cl. ..... 313/549; 313/25; 313/559

[58] Field of Search ..... 313/553, 554, 313/559, 549, 634, 563, 564, 566, 565, 25, 27, 642, 638, 639, 640, 641

[56] References Cited

U.S. PATENT DOCUMENTS

| | | | |
|---|---|---|---|
| 3,626,229 | 12/1971 | Spacil | 313/25 |
| 4,312,669 | 1/1982 | Buffito et al. | 420/422 |
| 4,859,899 | 8/1989 | Keeffe et al. | 313/25 |
| 4,918,352 | 4/1990 | Hess et al. | 313/25 |
| 4,935,668 | 6/1990 | Hansler et al. | 313/634 |
| 4,963,790 | 10/1990 | White et al. | 313/25 |
| 5,057,743 | 10/1991 | Krasko et al. | 313/639 |
| 5,312,606 | 5/1994 | Buffito et al. | 313/481 |
| 5,327,042 | 7/1994 | Bazin et al. | 313/25 |
| 5,457,354 | 10/1995 | Tay | 313/25 |
| 5,466,987 | 11/1995 | Williamson | 313/25 |
| 5,493,167 | 2/1996 | Mikol et al. | 313/25 |
| 5,543,121 | 8/1996 | Buffito et al. | 423/210 |

*Primary Examiner*—Michael Horabik
*Assistant Examiner*—Michael Day
*Attorney, Agent, or Firm*—William H. McNeill

[57] ABSTRACT

A metal halide discharge lamp includes an outer evacuated sealed glass envelope having a domed end and a socket end spaced from the domed end along a longitudinal axis. The socket end is subject to high temperature sealing fires during the lamp manufacturing process. A getter material is contained in the envelope for removing gaseous materials therefrom, the getter material being positioned in the envelope in an area of the lamp remote from the socket end. A pair of electrical conductors extend into the interior of the glass envelope and an arc tube containing an arc sustaining chemical fill and including a pair of spaced electrodes is electrically connected to the electrical conductors for creating an electric arc during operation of the lamp. The getter material comprises about 70 weight percent zirconium, about 24.6 weight percent vanadium, and about 5.4 weight percent iron. The activation temperature of the getter is in the range of 400°–500° C.

1 Claim, 2 Drawing Sheets

METAL HALIDE LAMP WITH GETTER

This is a continuation of application Ser. No. 08/598,756, filed on Feb. 8, 1996 now abandoned.

TECHNICAL FIELD

This invention relates to low wattage metal halide lamps and more particularly to metal halide high intensity discharge lamps utilizing an improved getter for the outer envelope of the lamp.

BACKGROUND ART

The use of getters in the outer envelopes of metal halide discharge lamps is known. See, for example, U.S. Pat. No. 5,327,042, which is assigned to the assignee of the present invention. For one reason or another established getters occasionally become unavailable or competitive conditions demand improvements in lamp operating parameters which extend beyond the range of existing getter materials. Accordingly, it will be an advance in the art to provide a new getter for metal halide discharge lamps.

DISCLOSURE OF INVENTION

It is, therefore, an object of the invention to obviate the disadvantage of the prior art.

It is another object of the invention to enhance the operation of metal halide discharge lamps.

Still another object of the invention is the provision of a more cost effective getter.

These objects are accomplished, in one aspect of the invention by the provision of a metal halide discharge lamp which comprises an outer evacuated sealed glass envelope having a domed end and a socket end spaced from the domed end along a longitudinal axis. The socket end is subject to high temperature sealing fires during the lamp manufacturing process. A getter material is contained in the envelope for removing gaseous materials therefrom, the getter material being positioned in the envelope in an area of the lamp remote from the socket end. A pair of electrical conductors extend into the interior of the glass envelope and an arc tube containing an arc generating and sustaining chemical fill and including a pair of spaced electrodes is electrically connected to the electrical conductors for creating an electric arc during operation of the lamp. The getter material comprises about 70 weight percent zirconium, about 24.6 weight percent vanadium, and about 5.4 weight percent iron. The activation temperature of the getter is in the range of 400°–500° C. Previous getters, such as type St101 available from the SAES GETTERS U.S.A. INC. required activation temperatures in the range of 750°–900° C. Lamps employing getters having the formulation as described herein are much less sensitive to lamp processing and will stabilize more rapidly than getters previously used. Even lamps wherein the getters receive no activation will be at normal operating conditions within 100 hours of operation.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
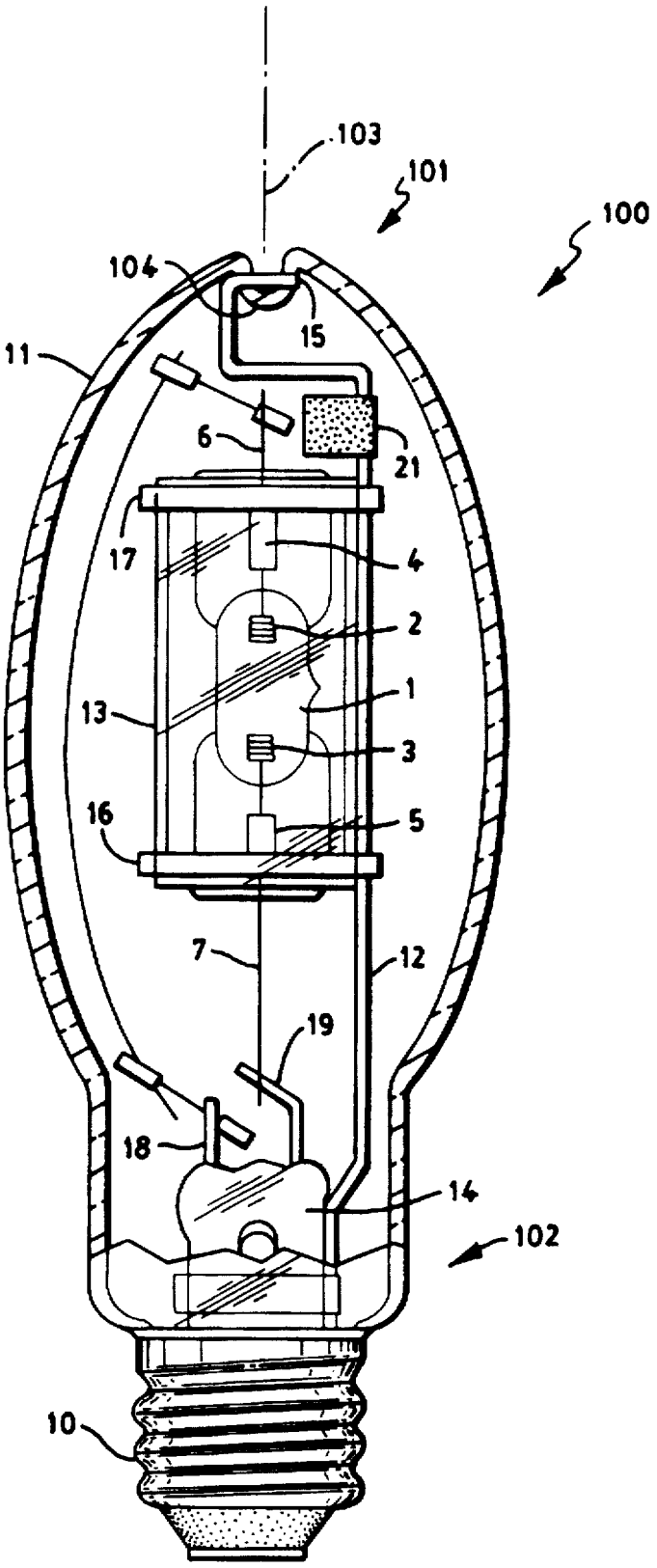
FIG. 1 is an elevational view, partially in section, of a lamp employing an embodiment of the invention.

Referring now to the drawings with greater particularity, there is shown in FIG. 1 an arc discharge lamp 100 having a quartz discharge tube or arc tube 1 disposed within an outer sealed glass envelope 11. The outer envelope 11 has a domed end 101 and a socket end 102 which is spaced from the domed end along a longitudinal axis 103. The envelope 11 is evacuated and is hermetically sealed to a glass stem 14 at the socket end 102 and has an external base 10. The socket end 102 is subject to high temperature sealing fires (in the neighborhood of 800° C.) during the lamp manufacturing process when the outer envelope 11 is sealed to glass stem 14. A pair of electrical conductors 18 and 19 is sealed into and pass through the stem 14.

The discharge tube 1 has a pair of electrodes 2 and 3 which project into the interior of the tube 1 at respective ends for energization of the discharge lamp by an external source (not shown) during operation. The discharge tube 1 is generally made of quartz although other types of materials may be used, such as alumina, yttria or fused silica. Each electrode 2 and 3 comprises a core surrounded by molybdenum or tungsten wire coils.

Each of the electrodes 2 and 3 is connected to a to respective metal foils or ribbons 4 and 5, preferably formed of molybdenum, as is known, and which are pinched sealed in the ends of the tube 1. Electrical conductors 6 and 7 which are respectively connected to foils 4 and 5, extend outwardly to the respective press seals. Conductors 6 and 7 are respectively connected to the conductors 18 and 19 projecting from the glass stem 14. As illustrated, the connection between conductor 6 and conductor 18 is made by a vertically disposed wire extending exterior to the shroud 13. A getter 21 in accordance with the invention is affixed to support structure 12 in the domed end 101. In the embodiment shown in FIG. 1, the domed end 101 is provided with an inwardly extending dimple 104 around which an end 15 of support structure 12 is looped.

The getter is comprised of 70 weight percent (w %) zirconium; 24.6 w % vanadium and 5.4 w % iron, and can be deposited and firmly fixed on metallic strips as shown or it can be compressed in the form of pills or washers.

The discharge tube 1, which is positioned within the shroud or radiation shield 13, is electrically isolated from the shield 13 and the support structure 12. Such a "floating frame" design is used to control the loss of alkali metal from the arc tube fill and is shown in U.S. Pat. Nos. 5,057,743 and 4,963,790.

The radiation shield 13 is secured to the support structure 12 by spaced apart straps 16 and 17 which are respectively welded to a vertically aligned portion of the support member 12. In this instance, the shield 13 has a cylindrical shape an is typically in the form of a quartz sleeve which may or may not have a domed shaped closure at one end. Each of the straps 16 and 17 is made of a spring-like material so as to grippingly hold the shield 13 in position. As set forth in U.S. Pat. No. 4,859,899, the diameter and length of the shield may be chosen with respect to the arc tube dimensions to achieve the optimal radiation redistribution resulting in uniform arc tube wall temperatures.

Figure 2:
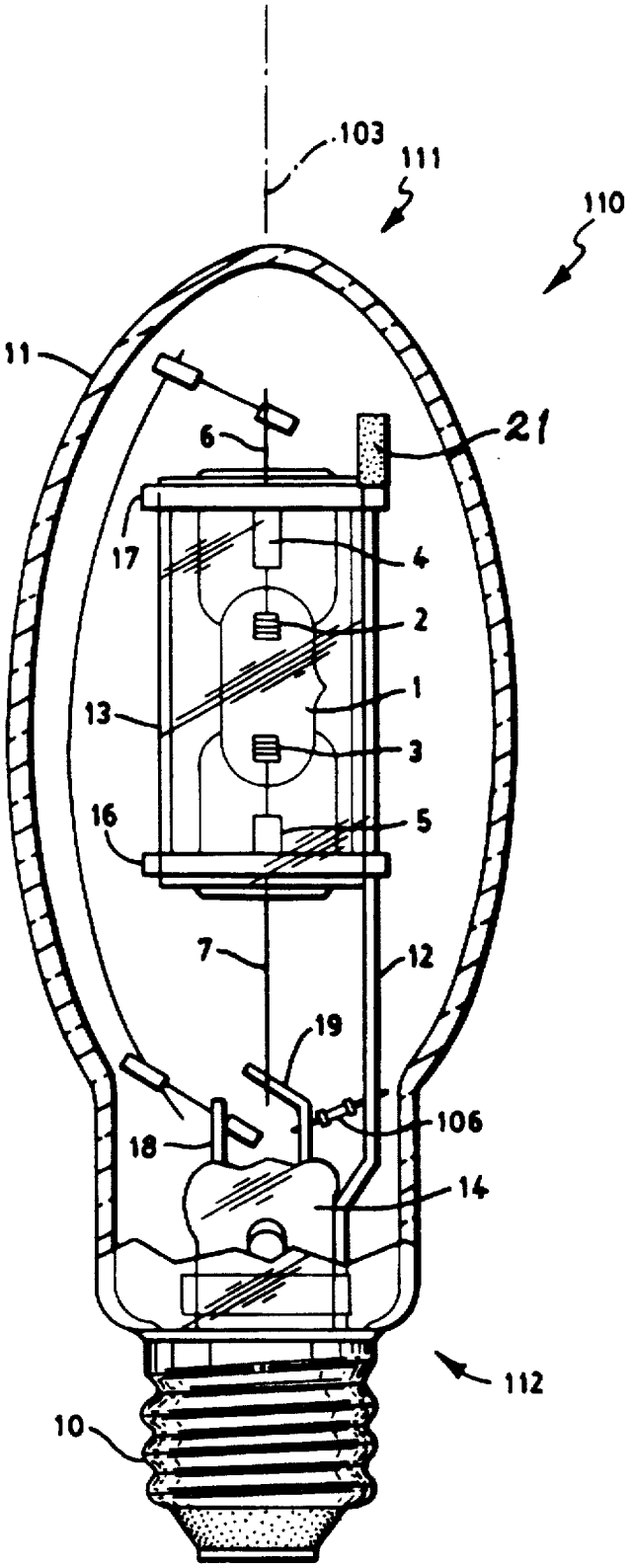
FIG. 2 is a similar view employing an alternate embodiment.

Referring now to FIG. 2 an alternate style of discharge lamp 110 is depicted. Lamp 110 is similar to lamp 100 in all respects except the shape of the domed end 111 which, in the latter version, is missing the inwardly extending dimple. All support for the structure of lamp 110 is provided at the lower or socket end 112 and may employ an isolation bridge 106 of the type shown in U.S. Pat. No. 5,457,354 or the supporting structure shown in U.S. Pat. No. 5,466,987, both of which are assigned to the assignee of the present invention and whose appropriate teachings are herein incorporated. In either event, without having the upper portion of support 12, the getter 21 can be affixed to the metal band 17 at the end of shield 13 adjacent the domed end 111. In this position the getter is still remote from the deleterious sealing fire temperatures which exist during lamp manufacture at the socket end. It is mandatory that the getter comprised of the material described herein be placed remote from the sealing fire temperatures since those temperatures, in the neighborhood of 800° C., will burn up and destroy the getter.

The preferred getter material, which comprises 70 w % zirconium, 24.6 w % vanadium and 5.4 w % iron is available from SAES Getters USA INC. as type St707. The optimum conditions to achieve full getter activation are a getter temperature of 400°–500° C. for approximately 10 minutes. Lower temperatures can be employed; however, then the time must be extended.

While there have been shown and described what are at present considered the preferred embodiments of the invention, it will be apparent to those skilled in the art that various changes and modifications can be made herein without departing from the scope of the invention as defined by the appended claims.

What is claimed is:

1. A metal halide discharge lamp comprising: an outer evacuated sealed glass envelope having a domed end and a socket end spaced from said domed end along a longitudinal axis, said socket end being subject to high temperature sealing fires during the lamp manufacturing process, and a getter material contained in said envelope for removing gaseous materials therefrom, said getter material being positioned only in said envelope in an area of said lamp remote from said socket end and closely adjacent said domed end; a pair of electrical conductors extending into the interior of said glass envelope; an arc tube containing an arc sustaining chemical fill and including a pair of spaced electrodes being electrically connected to said electrical and including a pair of spaced electrodes being electrically connected to said electrical conductors for creating an electric arc during operation of said lamp, said arc tube being provided with an at least partially surrounding shroud of a suitable material, said getter material comprising about 70 weight percent zirconium, about 24.6 weight percent vanadium, and about 5.4 weight percent iron, said surrounding shroud being supported by upper and lower straps affixed to a wire support within said envelope and said getter is affixed to said upper strap adjacent said dome end of said envelope.

* * * * *